United States Patent [19]

Albery

[11] 3,999,397

[45] Dec. 28, 1976

[54] MODULAR DOCK SYSTEM

[76] Inventor: Lewis L. Albery, 14429 Dante, Dolton, Ill. 60419

[22] Filed: Jan. 2, 1976

[21] Appl. No.: 646,336

[52] U.S. Cl. ..... 61/48; 52/263; 52/620; 52/629; 108/64

[51] Int. Cl.[2] ..... E02B 3/20; E04B 1/00

[58] Field of Search ..... 61/48; 182/178, 222; 108/64, 59; 52/620, 629, 630, 370, 371, 380; 14/73; 52/263, 479, 664; 114/201 R

[56] References Cited

UNITED STATES PATENTS

| | | | |
|---|---|---|---|
| 2,730,412 | 1/1956 | Yoder | 182/222 X |
| 3,081,601 | 3/1963 | Fentiman | 61/48 |
| 3,316,680 | 5/1967 | Chrastek | 52/263 X |
| 3,455,115 | 7/1969 | Watts et al. | 61/48 |
| 3,555,762 | 1/1971 | Costanzo, Jr. | 114/.5 P X |

*Primary Examiner*—Jacob Shapiro
*Attorney, Agent, or Firm*—Mason, Kolehmainen, Rathburn & Wyss

[57] ABSTRACT

A modular dock system comprising one or more dock panels adapted to be interconnected into a pier, each of said panels comprising a plurality of elongated extruded aluminum panel members having a flat upper wall, a pair of side walls having flanges along the lower edges and a central rib structure having lower flanges parallel of the flanges on the side wall, a pair of aluminum cross-members at opposite ends of the panel members have channel shaped cross-section and a web secured to the flanges of said panel members and a pair of downwardly extending side flanges, one of said cross-members spaced inwardly, parallel of the adjacent ends of the panel members and the other of said cross-members having an outside flange spaced outwardly parallel of the opposite adjacent ends of the panel members thereof and a thin sheet of skid resistant plastic material adhesively secured to the upper surface on the upper wall of said panel members.

10 Claims, 6 Drawing Figures

MODULAR DOCK SYSTEM

BACKGROUND OF THE INVENTION

1. Field of the Invention

The present invention relates to a modular dock system and more particularly to a portable, light weight, dock system which can be easily installed and taken down on a seasonable basis with a minimum of work involved.

It is an object of the present invention to provide a new and improved modular dock system of the character described.

More particularly, it is an object to provide a modular dock system which is constructed of strong, light weight, extruded aluminum panel members which are corrosion and weather resistant and neat in appearance.

Another object of the present invention is to provide a modular dock system having new and improved dock panels which are readily attached in end to end or end to side relationship with a minimum of labor being required.

Yet another object of the present invention is to provide a new and improved modular dock system which is extremely pleasing in appearance and which employs a thin sheet of decorative and skid resistant plastic material adhesively secured to the upper surface of the panel members of the dock panels.

Another object of the present invention is to provide a new and improved modular dock panel which is relatively light in weight yet extremely strong and pleasing to the eye.

Yet another object of the present invention is to provide a new and improved modular dock system in which dock panels can be interconnected in a wide variety of arrays, patterns and combinations to provide for a wide variety of designs or layouts required or designed for a marina or the like.

Yet another object of the present invention is to provide a new and improved modular dock system of the character described which is virtually maintenance free, extremely safe for both children and adults and including easily handled panels which are readily stackable in a relatively small, compact storage volume during the off season.

Yet another object of the invention is to provide a new and improved modular dock system having novel dock panels which can be manufactured in a wide variety of different widths and lengths, as desired or required for a particular installation.

2. Description of the Prior Art

Wooden docks and piers supported on heavy "H-type" saddle structures are in common use in many lakes and waterways throughout the country. These docks suffer from the disadvantage that the wood is heavy and eventually rots or is gradually disintegrated by water and wave action or by boats in contact therewith. In addition, most wooden docks require constant or at least annual maintenance and attention and are generally heavy and cumbersome to install and take out. Moreover, wooden docks are heavy and cumbersome to store, and the task of putting in a dock every Spring and then taking the dock out of the water in the Fall is time consuming, laborious and costly.

In recent years, several attempts have been made to produce a lighter weight, less cumbersome dock system. The Holiday Distributing Company of Jackson, Michigan has manufactured both aluminum and wooden dock systems wherein the dock panels employ longitudinal structural edge members for supporting transverse cross-members interlocked together. Because the longitudinal members must support the entire dead weight of the cross-members and their own weight as well, these docks are relatively bulky and require relatively heavy structural longitudinal members and this results in a heavy, as well as a relatively expensive structure.

SUMMARY OF THE INVENTION

The foregoing and other objects and advantages of the present invention are accomplished in a portable modular dock system comprising one or more dock panels adapted to be interconnected together into a pier or dock. Each of the dock panels comprises a plurality of elongated, extruded aluminum panel members, arranged in side by side relation with a slight spacing provided between adjacent edges of the panel members. Each panel member is formed of an aluminum extrusion having a flat upper wall, a pair of depending side walls having flanges along their lower edges and a central rib structure, also having lower flanges parallel of the flanges on the side walls. A pair of aluminum cross-members are provided at opposite ends of the panel members and each is of channel shaped cross-section having a web secured to the flanges on the panel members and each includes a pair of downwardly extending side flanges. One of the cross-members is spaced inwardly parallel of the adjacent ends of the panel members and the other cross-member has an outside flange spaced outwardly parallel of the adjacent opposite ends of the panel members.

Thin sheets of decorative, skid resistant plastic material are adhesively secured to the upper surface of the upper walls of the panel members. The dock panels may be interconnected in longitudinal end to end relation and in this arrangement, the end portion of the panel members of one dock panel overlie and are supported on the web of the cross-member of an adjacent dock panel. The dock panels may also be interconnected with the end of one panel abutting and supporting the side of a dock panel arranged at right angles thereto with the outside flange on the panel member at right angles being supported on the web of the cross-member of the dock panel normal thereto. The dock panels are supported on "H-type" frames or saddles and are readily secured in place thereon. The skid resistant material comes in a variety of different colors and may be cut to different sizes and patterns to provide an extremely pleasing appearance and the dock panels are light in weight, strong, easily handled and weather and corrosion resistant.

BRIEF DESCRIPTION OF THE DRAWINGS

For a better understanding of the present invention, reference should be had to the following detailed description taken in conjunction with the drawings, in which.

BRIEF DESCRIPTION OF THE PREFERRED EMBODIMENTS

Figure 1:
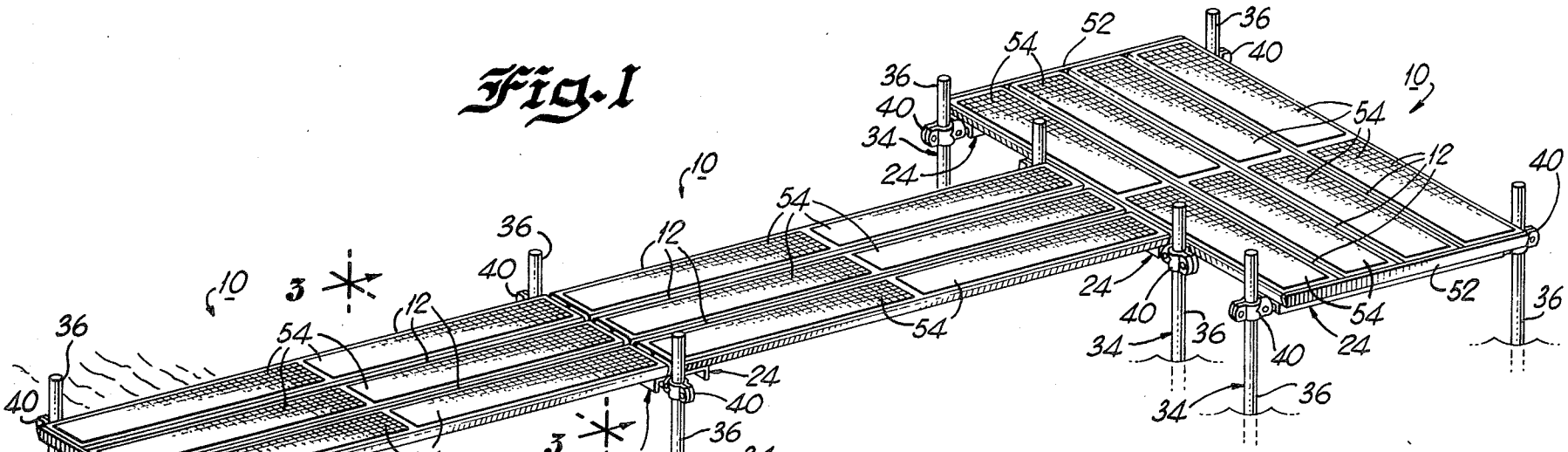
FIG. 1 is a perspective view of a pier or dock system constructed with a modular dock panel in accordance with the present invention.

Referring now more particularly to the drawings, in FIG. 1 is illustrated a pier or dock system constructed with a plurality of interconnected dock panels 10 in accordance with the features of the present invention. Each dock panel 10 includes a plurality of elongated panel members 12 formed of extruded aluminum, and referring to FIG. 3, any number of panel members may be placed side by side to provide the desired width. The length of the panels is selected to provide convenient modular lengths such as 8', 10' or 12' and longer lengths may be provided by increasing the wall thickness of the extrusions dependant on the loads that the dock is designed to support.

The panels 12 are formed with a relatively thin flat upper wall 14 with a pair of integral downwardly and inwardly sloping side walls 16 along opposite edges. The side walls and the upper wall are joined in a rounded portion so that a smooth water shed is provided without sharp corners. Adjacent panel members are spaced slightly apart by a distance *d* (FIG. 3), which distance is great enough to permit free water drainage yet small enough to block the entry of fingers or toes of little children. The dock panels are thus self-draining for the most part which reduces the chances of a person slipping on the surface.

At the lower edge, each side wall 16 is formed with an inturned flange structure 18 which is parallel of the upper wall 14 and includes an upstanding rib 19 to provide added stiffness for the flange. Each panel element 12 also includes a centrally disposed, integral T-shaped stiffening structure 20 having a pair of outwardly extending lower flanges 22 formed with upstanding stiffening ribs 23 adjacent their outer edges.

The aluminum panel extrusions 12 are available from the "Kaiser Aluminum Company" and are sold by the name "stadium Seating". The structural shape or profile of the panel extrusions 12 (FIGS. 3 and 4) provides for lightness in weight with exceptional strength. No sharp edges or corners are present to a person walking on the upper surface of the dock panels 10 and drainage of water is aided by the rounded edge portion.

Each dock panel includes a pair of channel shaped, transverse cross-members 24 and these cross-members have a web flat portion 26 with a pair of downwardly extending opposite side flanges 28. The undersurface of the side wall flanges 18 and the central flanges 22 rest upon the webs 26 of the cross-members 24 and are preferably secured to the channels by an aluminum heliarc welding process or other suitable welding or fastening arrangement. The cross-members hold the panel members together and provide a structure 10 that is strong, light in weight, and easy to handle. Because the panel extrusions 12 extend longitudinally of the dock panels 10 rather than transversely and because these members form the upper walking surface of the dock, they carry their own weight as well as support the structure as a whole and this results in a material savings. The channel shaped cross-members 24 are conventionally available aluminum channels and are sized for sufficient strength for the span involved. The number of panel elements 12 in a particular panel 10 are selected to provide the desired width.

Figure 2:
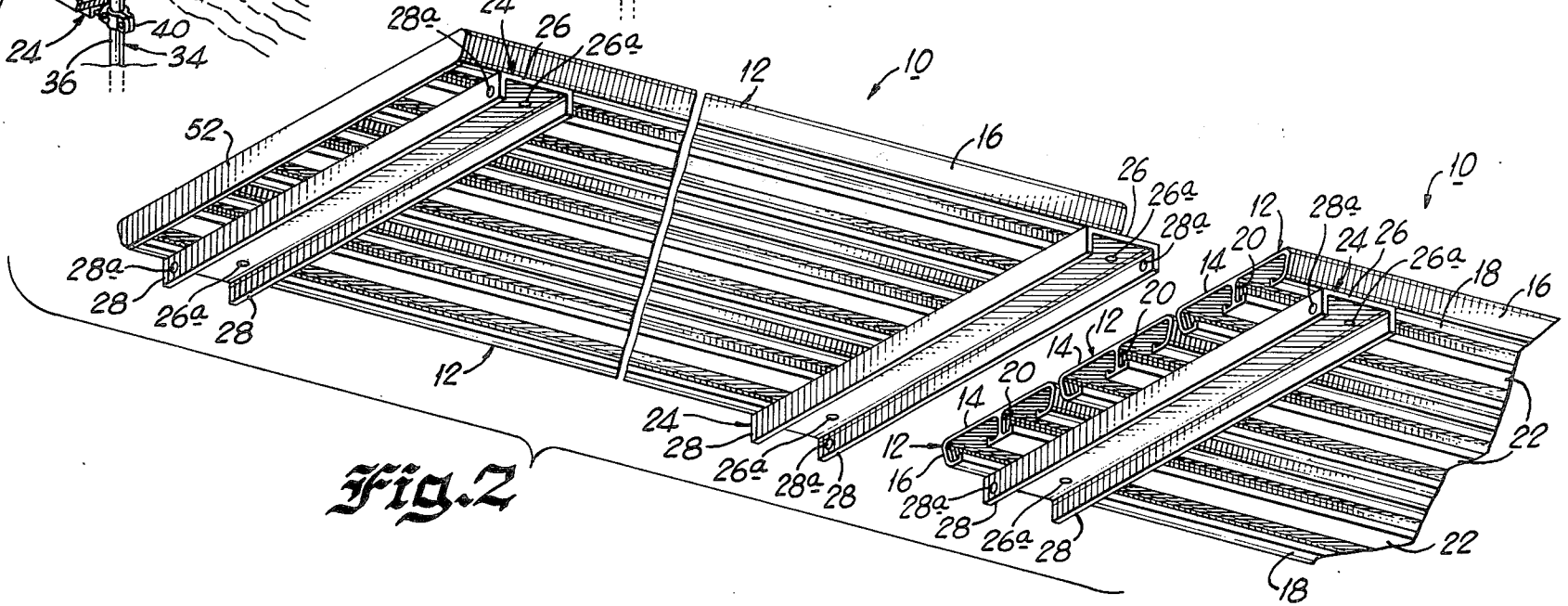
FIG. 2 is a perspective view of the underside of portions of a pair of dock panels constructed in accordance with the present invention.
Figures 3, 4, 5, 6:
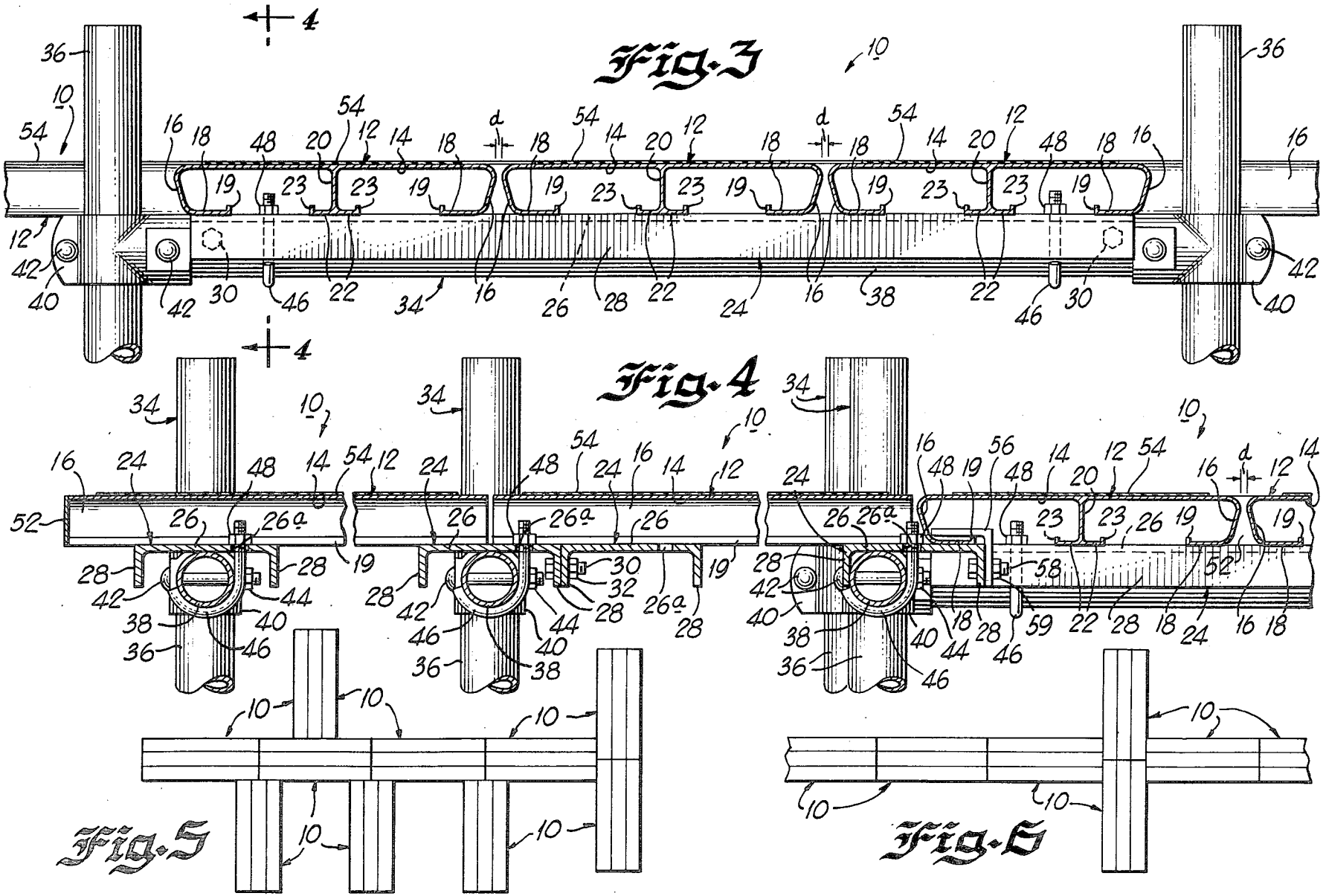
FIG. 3 is a vertical sectional view taken substantially along lines 3—3 of FIG. 1.
FIG. 4 is a vertical sectional view taken substantially along lines 4—4 of FIG. 3.
FIG. 5 is a top plan view of a typical pattern for a pier or dock system employing dock panels of the invention arranged to provide separate boat slips along a relatively long pier.
FIG. 6 is a top plan view of yet another pattern of a dock system constructed with the dock panels of the present invention.

Referring to FIGS. 2 and 4, the cross-members or channels 24 at one end of the dock panels are inset from the adjacent outer ends of the panel extrusions 12 and at the opposite end of the dock panel, the cross-member is secured so that an outer edge flange 28 is spaced outwardly from the adjacent ends of the extrusions. As shown in FIG. 4, this arrangement provides a convenient means for interconnecting a plurality of the dock panels 12 in a longitudinal end to end relation for making up a long pier or dock system. This arrangement provides a system wherein end portions of the panel extrusions 12 on one dock panel 10 project over and are supported on the web 26 of the cross-member of the next adjacent dock panel. The outer side flanges 28 of the adjacent cross-member 24 of the panels are positively secured together by removable fasteners such as aluminum, galvanized or stainless steel bolts 30 and nuts 32 as shown. The shanks of these bolts pass through openings 28a provided in the outside flanges of the cross-members 24 as best shown in FIG. 2.

The dock panels 10 are supported above the water on "H-frame" saddle structures 34 which are placed transversely of the dock panels at appropriate intervals along the length of the pier or dock system. Each "H-frame" includes a pair of spaced apart support posts 36 which are driven into the bottom of the water body and appropriately anchored in place. The posts support a cross-member or saddle bar 38 which is interconnected to the posts by a pair of connector assemblies 40 at opposite ends. The connectors are formed in two parts or halves and are adjustable on the posts to provide for the desired level of the saddle. Bolts 42 and nuts 44 provide a convenient way of securing the connectors in place on the posts 36 to support the saddle bar 38. The posts and saddle bars are formed of hollow tubing and various tubing material may be used such as galvanized steel or aluminum to provide corrosion resistance.

The dock panels 10 are secured to the saddle structures 34 by means of J-bolts 46 and nuts 48 as shown. The hooked lower end of the J-bolts clamps the web of the channels firmly to the saddle bar 38 and the shank of the J-bolt extends upwardly through an opening **26*a* to receive a nut 48. The horizontal saddle bars 38 are aligned between the flanges 28 of the cross-members 24 on the dock panels and accordingly provide very little in the way of depending obstructions below the dock structure. Moreover, the J-bolts are protected by the channel flanges and as shown in FIG. 3, the nuts 48 are easily accessible from the ends of the panel members 12.**

When an end or both ends of a dock panel 10 are to be exposed as shown in FIG. 1, an end plate 52 is attached to the ends of the panel extrusions 12. This provides for a nice appearance, adds strength and eliminates any sharp corners from possible contact with the foot of a person on the dock structure. Also, if required, the cross-members 24 on both ends of a dock panel 10 may be inset or flush with the ends of the panel extrusions 12 at places where no connection to another dock panel is contemplated.

In accordance with the invention, the flat upper surface of the upper wall 14 of the panel members 12 is covered with a decorative, non-skid surfacing material 54 which is preferably applied with an adhesive coating on the material. A thin sheet of suitable, adhesive backed, non-skid sheet material is manufactured and sold by the Minnesota Mining and Manufacturing Co., under the name "SAFETY-WALK". This material comes in a variety of colors and is sold in rolls which are then cut to appropriate length. To apply the sheets 54, the backing member is peeled away and the exposed adhesive is then pressed against the upper wall surface 14 of the panel extrusions 12. In order to reduce the possibility of the non-skid material scuffing along the edges and separating away from the upper wall surface of the panel extrusions, additional sealing or adhesive material such as an "Edge Sealing Compound" by "3M" is used around the marginal edges of each sheet of non-skid surfacing material 54.

Referring to FIG. 4, when it is desired to interconnect the dock panels 10, with the end of one panel abutting the longitudinal side of an adjacent panel, a plurality of angle clips 56 are provided with the upper horizontal flange overlying the side wall flange 18 and lip 19 along the edge of the panel. The vertical flanges of the angle clips are bolted to the cross-member side flange 28 with bolts 58 and nuts 59 to secure the dock panels 10 together as shown.

Although the present invention has been described with reference to a single illustrative embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A modular dock system comprising:

at least a pair of dock panels interconnected in end to end relation, each of said dock panels comprising a plurality of side by side, elongated extruded aluminum panel members having a flat upper wall, a pair of side walls having flanges along the lower edges and a central rib structure having lower flanges parallel of said flanges on said side wall, each panel including, a pair of aluminum cross-members at opposite ends of said panel members having a channel shaped cross-section with a web secured to said flanges and a pair of downwardly extending side flanges, one of said cross-members of each panel spaced inwardly, parallel of the adjacent ends of said panel members and the other of said cross-members of said panel having an outer side flange spaced outwardly parallel of the adjacent ends of said panel members, and a thin sheet of skid resistant plastic material adhesively secured to the upper surface on said upper wall of said panel members, the end portions of panel members on one dock panel overlying the web of a cross-member on the other dock panel and fastener means for interconnecting adjacent facing flanges of adjacent dock panels.

2. The modular dock system of claim 1 wherein said panel members are secured to said cross-members by welding the flanges of said panel members to the web of said cross-members.

3. The modular dock system of claim 2 wherein adjacent facing side walls of adjacent panel members are spaced apart permitting drainage from the upper walls of said panel members.

4. The modular dock system of claim 1 including at least one end plate secured across adjacent ends of said panel members.

5. A modular dock system comprising:

a pair of dock panels interconnected with an end of one dock panel adjacent a side wall on a panel member of the other dock panel at right angles thereto, each of said dock panels comprising a plurality of side by side, elongated extruded aluminum panel members having a flat upper wall, a pair of side walls having flanges along the lower edges and a central rib structure having lower flanges parallel of said flanges on said side wall, each panel including a pair of aluminum cross-members at opposite ends of said panel members and having a channel shaped cross-section with a web secured to said flanges and a pair of downwardly extending side flanges, one of said cross-members of each panel spaced inwardly, parallel of the adjacent ends of said panel members and the other of said cross-members of said panel having an outer side flange spaced outwardly parallel of the adjacent ends of said panel members, and a thin sheet of skid resistant plastic material adhesively secured to the upper surface on said upper wall of said panel members;

a flange of said side wall on said other dock panel overlying the web on the adjacent cross-member of said one dock panel and fastener means securing said flange and said adjacent cross-member.

6. The modular dock system of claim 5 wherein said fastener means includes an angle member having one flange overlying said flange of said side wall of said other dock panel and another flange secured to a flange of said adjacent cross-member of said one dock panel.

7. The modular dock system of claim 1 including at least one H-frame for supporting a dock panel, said H-frame including a pair of posts and a saddle member, said saddle member extending between the flanges of a cross-member of said dock panel and secured thereto below the web thereof.

8. The modular dock system of claim 7 including removable fastening means for securing said saddle member to said web of said cross-member.

9. The modular dock system of claim 8 wherein said removable fastening means includes a hook shaped member having a lower portion engaging the underside of said saddle member and an upper threaded shank extending through an opening in said web of said cross-member supported on said member.

10. The modular dock system of claim 5 including at least one H-frame for supporting a dock panel, said H-frame including a pair of posts and a saddle member, said saddle member extending between the flanges of a cross-member and secured thereto below the web thereof.

* * * * *